US009721708B2

(12) United States Patent
Mizuno et al.

(10) Patent No.: US 9,721,708 B2
(45) Date of Patent: Aug. 1, 2017

(54) HIGH-TEMPERATURE SUPERCONDUCTING COIL AND METHOD OF MANUFACTURING SAME

(71) Applicant: RAILWAY TECHNICAL RESEARCH INSTITUTE, Tokyo (JP)

(72) Inventors: Katsutoshi Mizuno, Tokyo (JP); Masafumi Ogata, Tokyo (JP); Tomohisa Yamashita, Tokyo (JP)

(73) Assignee: RAILWAY TECHNICAL RESEARCH INSTITUTE, Tokyo (JP)

( * ) Notice: Subject to any disclaimer, the term of this patent is extended or adjusted under 35 U.S.C. 154(b) by 239 days.

(21) Appl. No.: 14/550,017

(22) Filed: Nov. 21, 2014

(65) Prior Publication Data

US 2015/0133304 A1 May 14, 2015

(30) Foreign Application Priority Data

Nov. 22, 2013 (JP) ..... 2013-241409

(51) Int. Cl.

| | |
|---|---|
| ***H01B 12/00*** | (2006.01) |
| ***H01F 6/06*** | (2006.01) |
| ***H01F 41/04*** | (2006.01) |

(52) U.S. Cl.

CPC ..... *H01F 6/06* (2013.01); *H01F 41/048* (2013.01)

(58) Field of Classification Search

CPC ..... H01F 41/048; H01F 6/06

(Continued)

(56) References Cited

U.S. PATENT DOCUMENTS 4,586,017 A * 4/1986 Laskaris ..... H01L 39/20 327/370
5,649,353 A * 7/1997 Salasoo ..... H01F 41/086 242/444

(Continued)

FOREIGN PATENT DOCUMENTS

JP H11-260625 A 9/1999
JP 2008-243588 A 10/2008

(Continued)

OTHER PUBLICATIONS

Office Action for Application No. JP 2013-241409 Dated November 22, 2016; English Translation of Notification of Reasons for Refusal.

*Primary Examiner* — Paul Wartalowicz
(74) *Attorney, Agent, or Firm* — Bacon & Thomas, PLLC

(57) ABSTRACT

There is provided a high-temperature superconducting (HTS) coil and a method of manufacturing the same, allowing simple and excellent affixation between side panels for cooling the superconducting coil and the HTS coil while inhibiting delamination of an HTS wire. The method of manufacturing the HTS coil including the rare-earth-based HTS wire of the superconducting coil and side panels for cooling the superconducting coil which are affixed thereto, windings of the rare-earth-based HTS wire of the superconducting coil being separated between turns, includes: utilizing a tape-like polytetrafluoroethylene (PTFE) film 3 as an insulator between the windings of the rare-earth-based HTS wire 2 to form a PTFE-film co-wound superconducting coil; impregnating the PTFE-film co-wound superconducting coil 4 with epoxy resin 6; and affixing the side panels 5 to the PTFE film co-wound superconducting coil 4.

12 Claims, 3 Drawing Sheets

(58) Field of Classification Search
USPC ..... 505/211
See application file for complete search history.

(56) References Cited

U.S. PATENT DOCUMENTS

| | | | | |
|---|---|---|---|---|
| 2002/0038664 | A1* | 4/2002 | Zenko | B32B 17/10743 136/251 |
| 2007/0188280 | A1* | 8/2007 | Park | H01F 6/04 335/216 |
| 2008/0070788 | A1* | 3/2008 | Kramer | H01L 39/16 505/191 |
| 2008/0274897 | A1* | 11/2008 | Wiezoreck | H02K 3/24 505/166 |
| 2013/0172196 | A1* | 7/2013 | Nick | H01F 6/06 505/166 |

FOREIGN PATENT DOCUMENTS

| | | | | |
|---|---|---|---|---|
| JP | 2013-143460 | | 7/2013 | |
| JP | 2013-143460 | A | 7/2013 | |
| WO | WO 2012/031790 | * | 3/2012 | H01F 6/06 |

* cited by examiner

HIGH-TEMPERATURE SUPERCONDUCTING COIL AND METHOD OF MANUFACTURING SAME

BACKGROUND OF THE INVENTION

1. Field of the Invention

The preset invention relates to a high-temperature superconducting (HTS) coil and a method of manufacturing the same.

2. Description of Related Art

While the conventional rare-earth-based high-temperature superconducting (HTS) wires have high tensile strength, they exhibit poor strength in the laminating direction of superconducting layers (the delaminating direction), leading to the problem of decreased performance of the superconducting coil due to the delamination.

In order to prevent the decrease in performance, low adhesive materials such as paraffin and cyanoacrylate resin have been used to impregnate the conventional superconducting coils formed of the rare-earth-based HTS wires (refer to Patent Document 1 listed below).

Patent Document 1: JP 2013-143460 A

SUMMARY OF THE INVENTION

However, as mentioned above, the conventional superconducting coils formed of the rare-earth-based HTS wires exhibit poor adhesiveness, so that the affixation between side panels serving as cooling patties and the superconducting wire is also weak. As a result, there have been structural problems to be improved such as the decreased cooling properties of the superconducting coil, as well as the increased risk of generating thermal runaway (fusion cutting, loss of function).

In view of the circumstances described above, the present invention is directed to provide an HTS coil and a method of manufacturing the same, allowing simple and excellent affixation between side panels for cooling the superconducting coil and the HTS coil while inhibiting delamination of the HTS wire.

In order to achieve the objective described above, the present invention provides the following:

[1] A method of manufacturing an HTS coil including a rare-earth-based HTS wire of the superconducting coil and side panels for cooling the superconducting coil to be affixed thereto, windings of the rare-earth-based HTS wire of the superconducting coil being separated between turns, the method including: utilizing a tape-like polytetrafluoroethylene (PTFE) film as an insulator between the windings of the rare-earth-based HTS wire to form a PTFE-film co-wound superconducting coil; impregnating the PTFE-film co-wound superconducting coil with epoxy resin; and affixing the side panels to the PTFE-film co-wound superconducting coil.

[2] A method of manufacturing an HTS coil including a rare-earth-based HTS wire of the superconducting coil and side panels for cooling the superconducting coil to be affixed thereto, windings of the rare-earth-based HTS wire of the superconducting coil being separated between turns, the method including: utilizing a tape-like polyimide film as an insulator between the windings of the rare-earth-based HTS wire; and affixing the side panels to the superconducting coil co-wound with the polyimide film by ethylene-methacrylic acid copolymer.

[3] A method of manufacturing an HTS coil including a rare-earth-based HTS wire of the superconducting coil and side panels for cooling the superconducting coil to be affixed thereto, windings of the rare-earth-based HTS wire of the superconducting coil being separated between turns, the method including: utilizing a tape-like PTFE film as an insulator between the windings of the rare-earth-based HTS wire; and affixing the side panels to the superconducting coil co-wound with the PTFE film by ethylene-methacrylic acid copolymer.

[4] An HTS coil including a rare-earth-based HTS wire of the superconducting coil and side panels for cooling the superconducting coil to be affixed thereto, windings of the rare-earth-based HTS wire of the superconducting coil being separated between turns, the HTS coil configured by: utilizing a tape-like PTFE film as an insulator between the windings of the rare-earth-based HTS wire to form a PTFE-film co-wound superconducting coil; impregnating the PTFE-film co-wound superconducting coil with epoxy resin; and affixing the side panels to the PTFE-film co-wound superconducting coil.

[5] An HTS coil including a rare-earth-based HTS wire of the superconducting coil and side panels for cooling the superconducting coil to be affixed thereto, windings of the rare-earth-based HTS wire of the superconducting coil being separated between turns, the HTS coil configured by: utilizing a tape-like polyimide film as an insulator between the windings of the rare-earth-based HTS wire; and affixing the side panels to the superconducting coil co-wound with the polyimide film by ethylene-methacrylic acid copolymer.

[6] An HTS coil including a rare-earth-based HTS wire of the superconducting coil and side panels for cooling the superconducting coil to be affixed thereto, windings of the rare-earth-based HTS wire of the superconducting coil being separated between turns, the HTS coil configured by: utilizing a tape-like PTFE film as an insulator between the windings of the rare-earth-based HTS wire; and affixing the side panels to the superconducting coil co-wound with the PTFE film by ethylene-methacrylic acid copolymer.

[7] The HTS coil according to any one of [4] to [6] above, wherein the side panels include oxygen-free copper.

[8] The HTS coil according to any one of [4] to [6] above, wherein the side panels include high purity aluminum.

[9] The HTS coil according to any one of [4] to [6] above, wherein the side panels include fiberglass reinforced plastic.

Effect of the Invention

According to the present invention, there is provided an HTS coil and a method of manufacturing the same, allowing simple and excellent affixation between side panels for cooling the superconducting coil and the HTS coil while inhibiting delamination of the HTS wire, for the purpose of improvements in cooling properties and thermal safety.

DESCRIPTION OF THE PREFERRED EMBODIMENTS

According to the present invention, the method of manufacturing an HTS coil including a rare-earth-based HTS wire of the superconducting coil and side panels for cooling the superconducting coil to be affixed thereto, windings of the rare-earth-based HTS wire of the superconducting coil being separated between turns, the method includes: utilizing a tape-like PTFE film as an insulator between the windings of the rare-earth-based HTS wire to form a PTFE-film co-wound superconducting coil; impregnating the PTFE-film co-wound superconducting coil with epoxy resin; and affixing the side panels to the PTFE-film co-wound superconducting coil.

Embodiments

Hereinafter, embodiments of the present invention will be described in detail.

Figure 1:
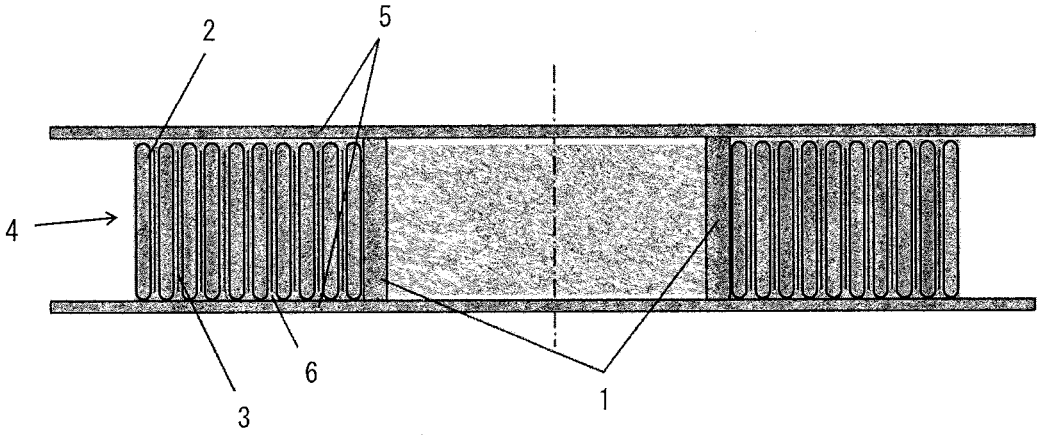
FIG. 1 shows a sectional view of a PTFE-film co-wound superconducting coil impregnated with epoxy resin, illustrating a first embodiment of the present invention.

FIG. 1 shows a sectional view of a PTFE-film co-wound superconducting coil impregnated with epoxy resin, illustrating a first embodiment of the present invention.

In this figure, reference numeral 1 denotes a spool made of fiberglass reinforced plastic, 2 denotes a rare-earth-based HTS wire, 3 denotes a tape-like PTFE film which is co-wound with the rare-earth-based HTS wire 2, 4 denotes a PTFE-film co-wound superconducting coil, and 5 denotes side panels of the superconducting coil which are affixed to the PTFE-film co-wound superconducting coil 4. The side panels 5 of the superconducting coil are formed of insulated high thermal conductive metal materials (e.g., oxygen-free copper, high purity aluminum) or fiberglass reinforced plastic. Reference numeral 6 denotes epoxy resin impregnated in the PTFE-film co-wound superconducting coil 4. The shape of the superconducting coil may be either a single pancake or double pancake.

Figure 2:
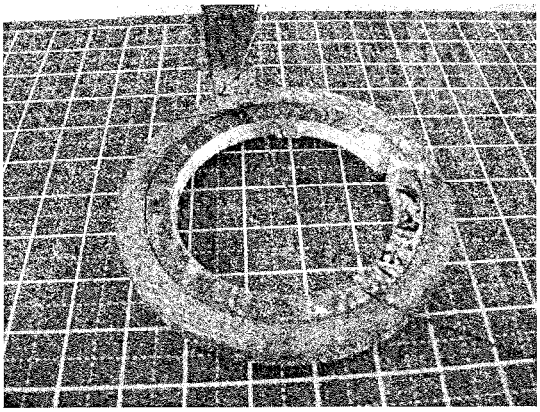
FIG. 2 shows a photograph substituted for a drawing of the PTFE-film co-wound superconducting coil after impregnation with epoxy resin, illustrating the first embodiment of the present invention.

FIG. 2 shows a photograph substituted for a drawing of the PTFE co-wound superconducting coil after impregnation with epoxy resin, according to this embodiment.

The specification of the superconducting coil here is as follows: inner diameter: 50 mm; outer diameter: 60 mm; number of turns: 40; cooling method: immersion in liquid nitrogen; superconducting wire: rare-earth-based HTS wire; wire width: approx. 4.0 mm; wire thickness: approx. 0.1 mm; interlayer insulating material: PTFE film; and thickness thereof: 0.025 mm.

As stated above, the first embodiment of the present invention provides the method of manufacturing the HTS coil including the rare-earth-based HTS wire of the superconducting coil and the side panels for cooling which are affixed to the side faces of the PTFE-film co-wound superconducting coil, windings of the rare-earth-based HTS wire of the superconducting coil being separated between turns, including: utilizing the tape-like PTFE film 3 as an insulator between the windings of the rare-earth-based HTS wire 2 to form the PTFE-film co-wound superconducting coil; and impregnating the PTFE-film co-wound superconducting coil 4 with the epoxy resin 6. The PTFE-film co-wound superconducting coil 4 is manufactured by winding the rare-earth-based HTS wire 2 along with the tape-like PTFE film 3, for example.

The PTFE film 3 exhibits poor adhesiveness to the epoxy resin 6, so that the windings of the rare-earth-based HTS wire 2 are separated between turns, thus no delamination occurs. In addition, the side faces of the superconducting coil are not covered with the PTFE film 3 and thus well affixed to the side panels 5.

Figure 3:
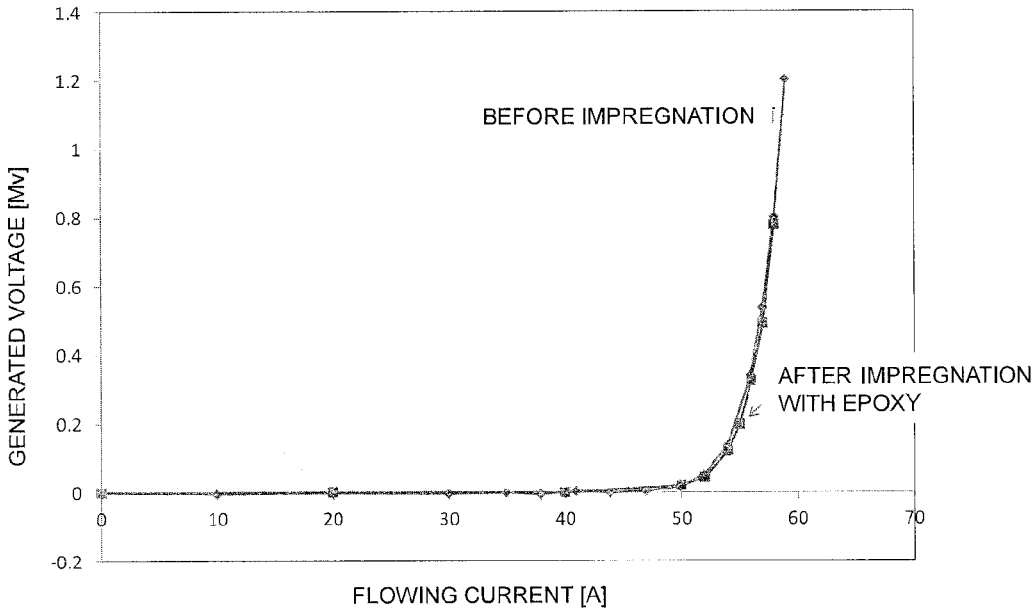
FIG. 3 is a graph showing the result of a current application test for the superconducting coil (before impregnation and after impregnation with epoxy resin), illustrating the first embodiment of the present invention.

FIG. 3 is a graph showing the result of a current application test for the superconducting coil (before impregnation and after impregnation with epoxy resin), according to this embodiment. In this graph, the symbol ♦ denotes before impregnation with epoxy resin, and the symbol ■ denotes after impregnation with epoxy resin.

As can be clearly seen from this graph, the method of manufacturing the superconducting coil according to the present invention does not cause delamination, regardless of the impregnation with epoxy resin being performed, and the decrease in performance of the superconducting coil is not observed.

Figure 4:
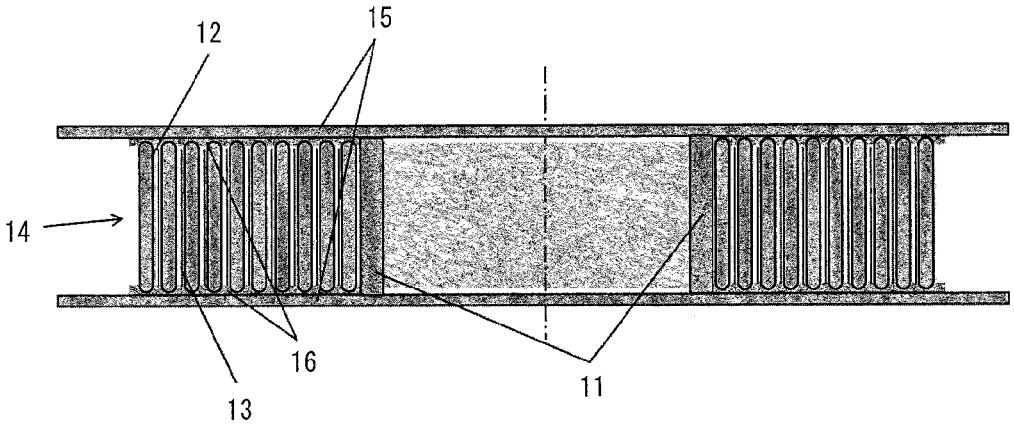
FIG. 4 shows a sectional view of a superconducting coil affixed to side panels by ethylene-methacrylic acid copolymer, illustrating a second embodiment of the present invention.

FIG. 4 shows a sectional view of a superconducting coil affixed to side panels by ethylene-methacrylic acid copolymer, illustrating a second embodiment of the present invention.

In this figure, reference numeral 11 denotes a spool made of fiberglass reinforced plastic, 12 denotes a rare-earth-based HTS wire, 13 denotes a tape-like polyimide film which is co-wound with the rare-earth-based HTS wire 12, 14 denotes a polyimide-film co-wound superconducting coil, 15 denotes side panels of the superconducting coil which are affixed to the polyimide-film co-wound superconducting coil 14, and 16 denotes ethylene-methacrylic acid copolymer to affix the polyimide-film co-wound superconducting coil 14 to the side panels 15 of the superconducting coil.

In addition, the side panels 15 of the superconducting coil is formed of insulated high thermal conductive metal materials (e.g., oxygen-free copper, high purity aluminum) or fiberglass reinforced plastic. The shape of the superconducting coil may be either a single pancake or double pancake.

Figure 5:
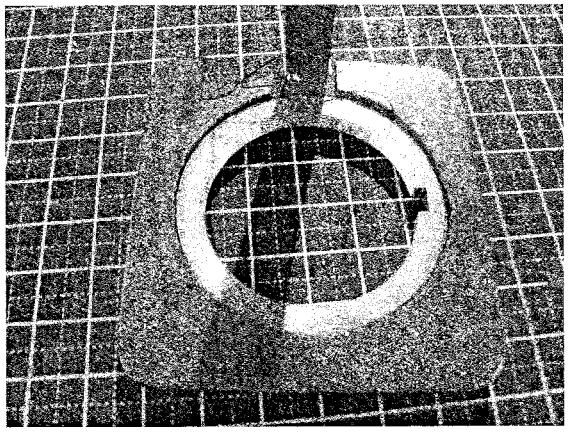
FIG. 5 shows a photograph substituted for a drawing of the superconducting coil affixed to the side panels by ethylene-methacrylic acid copolymer, illustrating the second embodiment of the present invention.

FIG. 5 shows a photograph substituted for a drawing of the superconducting coil affixed with the side panels by ethylene-methacrylic acid copolymer, according to this embodiment.

The specification of the superconducting coil here is as follows: inner diameter: 50 mm; outer diameter: 60 mm; number of turns: 40; cooling method: immersion in liquid nitrogen; superconducting wire: rare-earth-based HTS wire; wire width: approx. 4.0 mm; wire thickness: approx. 0.1 mm; interlayer insulating material: polyimide film; and thickness thereof: 0.025 mm.

As stated above, the second embodiment of the present invention provides the method of manufacturing the HTS coil including the rare-earth-based HTS wire of the superconducting coil and side panels for cooling which is affixed to the side faces of the superconducting coil, windings of the rare-earth-based HTS coil of the superconducting coil being separated between turns, including: utilizing the tape-like polyimide film as an insulator between the windings of the rare-earth-based HTS wire; and affixing the side panels to the superconducting coil co-wound with the polyimide film by ethylene-methacrylic acid copolymer.

The polyimide film mentioned above may be replaced by the PTFE film.

The method of manufacturing according to this embodiment includes: winding the rare-earth-based HTS wire 12 along with the polyimide film 13 or the PTFE film to form the polyimide-film (or PTFE-film) co-wound superconducting coil 14; and heating the side panels 15 having the ethylene-methacrylic acid copolymer 16 preliminarily affixed thereto while being applied to the side faces of the coil 14, so that the side panels 15 and the side faces of the coil 14 are affixed to each other. Other processes are contemplated, including: for example, winding the wire using a spool (not shown) with the side panels 15 attached thereto, having the ethylene-methacrylic acid copolymer 16 preliminarily affixed thereto, then heating the side panels, so that the ethylene-methacrylic acid copolymer 16 and the coil 14 are affixed to each other.

High viscosity of the ethylene-methacrylic acid copolymer 16 prevents it to permeate between the windings of the rare-earth-based HTS wire 12 when adhered to the side faces of the superconducting coil, thus no decrease in performance due to the delamination occurs and rather allowing the superconducting coil to be affixed well with the side panels 15.

Figure 6:
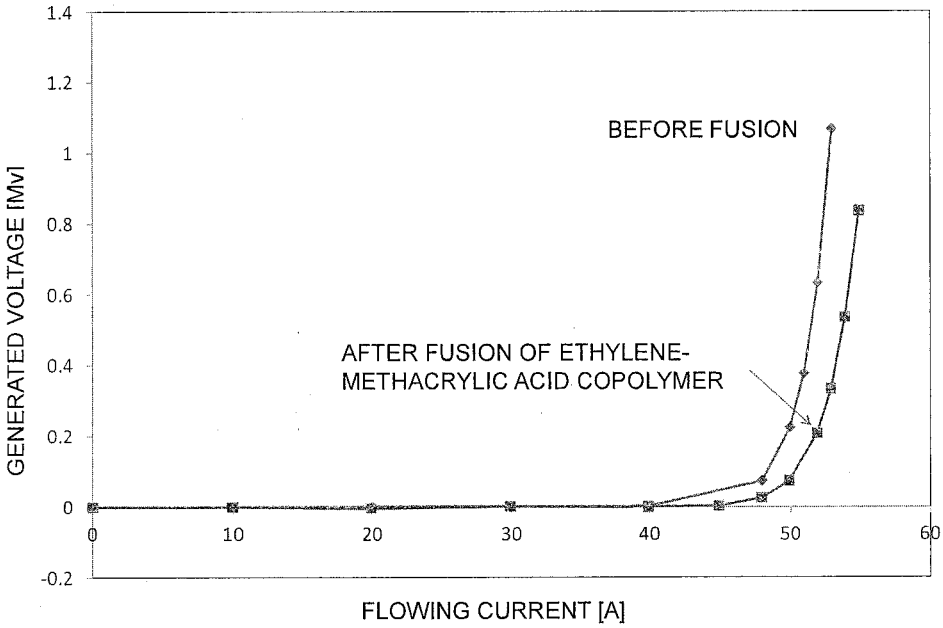
FIG. 6 is a graph showing the result of a current application test for the superconducting coil (before affixation and after affixation to side panels by ethylene-methacrylic acid copolymer), illustrating the second embodiment of the present invention.

FIG. 6 is a graph showing the result of a current application test for the superconducting coil (before affixation and after affixation with side panels by ethylene-methacrylic acid copolymer), according to this embodiment. In this graph, the symbol ♦ denotes before fusion of ethylene-methacrylic acid copolymer, and the symbol ■ denotes after fusion of ethylene-methacrylic acid copolymer.

As can be clearly seen from this graph, the method of manufacturing the superconducting coil according to the present invention does not present any decrease in performance due to the delamination.

The present invention should not be limited to the embodiments described above, and a number of variations are possible on the basis of the spirit of the present invention. These variations should not be excluded from the scope of the present invention.

INDUSTRIAL APPLICABILITY

The HTS coil and the method of manufacturing the same according to the present invention are applicable to allow simple and excellent affixation between the side panels for cooling the superconducting coil and the HTS coil while inhibiting delamination of the HTS wire, for the purpose of improvements in cooling properties and thermal safety.

What is claimed is:

1. A high-temperature superconducting (HTS) coil comprising:

a spool made of fiberglass reinforced plastic and having a generated magnetic field axis as a center;

a rare-earth-based HTS wire of the superconducting coil;

a tape-like polytetrafluoroethylene (PTFE) film co-wound with the HTS wire; and side panels for cooling the superconducting coil affixed thereto, wherein the HTS coil is configured by:

co-winding the PTFE film with the HTS wire to form a PTFE film co-wound superconducting coil, a wiring of the rare-earth-based HTS wire of the superconducting coil being separated between turns, impregnating the PTFE film co-wound superconducting coil with epoxy resin; and affixing the side panels to the PTFE-film co-wound superconducting coil by the epoxy resin.

2. The HTS coil according to claim 1, wherein the side panels include oxygen-free copper.

3. The HTS coil according to claim 1, wherein the side panels include high purity aluminum.

4. The HTS coil according to claim 1, wherein the side panels include fiberglass reinforced plastic.

5. A high-temperature superconducting (HTS) coil comprising:

a spool made of fiberglass reinforced plastic and having a generated magnetic field axis as a center;

a rare-earth-based HTS wire of the superconducting coil;

a tape-like polyimide film co-wound with the HTS wire; and side panels for cooling the superconducting coil affixed thereto, wherein the HTS coil is configured by:

co-winding the polyimide film with the HTS wire to form a polyimide film co-wound superconducting coil, a wiring of the rare-earth-based HTS wire of the superconducting coil being separated between turns, affixing the side panels to the polyimide film co-wound superconducting coil by ethylene-methacrylic acid copolymer.

6. The HTS coil according to claim 5, wherein the side panels include oxygen-free copper.

7. The HTS coil according to claim 5, wherein the side panels include high purity aluminum.

8. The HTS coil according to claim 5, wherein the side panels include fiberglass reinforced plastic.

9. A high-temperature superconducting (HTS) coil comprising:

a spool made of fiberglass reinforced plastic and having a generated magnetic field axis as a center;

a rare-earth-based HTS wire of the superconducting coil;

a tape-like PTFE film co-wound with the HTS wire; and side panels for cooling the superconducting coil affixed thereto, wherein the HTS coil is configured by:

co-winding the PTFE film with the HTS wire to form a PTFE film co-wound superconducting coil, a wiring of the rare-earth-based HTS wire of the superconducting coil being separated between turns, affixing the side panels to the PTFE film co-wound superconducting coil by ethylene-methacrylic acid copolymer.

10. The HTS coil according to claim 9, wherein the side panels include oxygen-free copper.

11. The HTS coil according to claim 9, wherein the side panels include high purity aluminum.

12. The HTS coil according to claim 9, wherein the side panels include fiberglass reinforced plastic.

* * * * *